US005448911A

United States Patent [19]

Mason

[11] Patent Number: 5,448,911

[45] Date of Patent: Sep. 12, 1995

[54] METHOD AND APPARATUS FOR DETECTING IMPENDING STICKING OF A DRILLSTRING

[75] Inventor: John S. Mason, Houston, Tex.

[73] Assignee: Baker Hughes Incorporated, Houston, Tex.

[21] Appl. No.: 19,402

[22] Filed: Feb. 18, 1993

[51] Int. Cl.[6] ..... E21B 47/00

[52] U.S. Cl. ..... 73/151

[58] Field of Search ..... 73/151; 175/40; 364/422

[56] References Cited

U.S. PATENT DOCUMENTS

| | | | |
|---|---|---|---|
| Re. 28,436 | 6/1975 | Vitter et al. | 73/151 |
| Re. 31,750 | 11/1984 | Morrow | 364/508 |
| 2,331,152 | 10/1943 | Willis | 73/51 |
| 2,620,386 | 12/1952 | Alspaugh et al. | 177/311 |
| 2,669,871 | 2/1954 | Lubinski | 73/151 |
| 2,985,829 | 5/1961 | Swift | 324/70 |
| 3,324,717 | 6/1967 | Brooks et al. | 73/152 |
| 3,345,867 | 10/1967 | Arps | 73/151 |
| 3,382,713 | 5/1968 | Chutter | 73/151 |
| 3,417,611 | 12/1968 | Dean et al. | 73/136 |
| 3,504,581 | 4/1970 | Weichbrodt et al. | 82/1 |
| 3,520,375 | 7/1970 | Raynal et al. | 175/24 |
| 3,548,648 | 12/1970 | Weichbrodt et al. | 73/104 |
| 3,581,564 | 6/1971 | Young | 73/151 |
| 3,626,482 | 12/1971 | Billere et al. | 175/25 |
| 3,694,637 | 9/1972 | Edwin et al. | 325/151.3 |
| 3,703,096 | 11/1972 | Vitter et al. | 73/151 |
| 3,714,822 | 2/1973 | Lutz | 73/104 |
| 3,774,445 | 11/1973 | Rundell | 73/151 |
| 3,782,190 | 1/1974 | Pittman | 73/151 |
| 3,793,627 | 2/1974 | Darrel et al. | 340/267 R |
| 3,809,870 | 5/1974 | Aauble et al. | 235/151.3 |
| 3,841,149 | 10/1974 | Edwin et al. | 73/71.4 |

(List continued on next page.)

FOREIGN PATENT DOCUMENTS

| | | |
|---|---|---|
| 1253717 | 11/1971 | United Kingdom . |
| 1330191 | 9/1973 | United Kingdom . |
| 1385625 | 2/1975 | United Kingdom . |

(List continued on next page.)

OTHER PUBLICATIONS

Philippe Bres Dissertation, *Comportement Vibratoire Des Tricones,* (May 14, 1975) Philippe Bres selected translations of Reference NF.

I. Finnie and J. J. Bailey, *An Experimental Study of Drill-String Vibration,* Journal of Engineering for Industry, (May 1060).

W. R. Garrett, *The Effect of a Downhole Shock Absorber on Drill Bit and Drill Stem Performance,* The American Society of Mechancial Engineers, (Jul. 11, 1962).

Fredric Deily, W. H. Dareing, G. H. Paff, J. E. Ortloff and R. D. Lynn., *New Drilling-Research Tool Shows What Happens Down Hole,* The Oil and Gas Journal, (Jan. 8, 1968).

R. A. Cunningham, *Analysis of Down Hole Measurement of Drill String Forces and Motions,* ASME Publication: Journal of Engineering for Industry, p. 208 (May 1968).

F. H. Deily, D. W. Dareing, G. H. Paff, J. E. Ortloff and R. D. Lynn, *Downhole Measurement of Drill String*

(List continued on next page.)

*Primary Examiner*—Hezron E. Williams
*Assistant Examiner*—Michael J. Brock
*Attorney, Agent, or Firm*—Melvin A. Hunn

[57] ABSTRACT

The present invention is directed to a method and apparatus for determining that a drillstring in a wellbore is susceptible to sticking against a wellbore surface. When characterized as a method, the method steps include (1) monitoring a vibration characteristic of the drillstring during drilling operations, and (2) comparing the vibration characteristic with at least one prior vibration characteristic to identify impending sticking. In the preferred embodiment, vibration amplitude is monitored to detect amplitude diminishment which is indicative of impending pipe sticking. Preferably, vibration data is subjected to a stabilizing signal processing operation which minimizes the adverse impact of noise and normalizes the data to facilitate comparison with prior time periods. Preferably, the data is presented and displayed in a time-domain format to allow visual comparison over a selected time interval.

64 Claims, 9 Drawing Sheets

U.S. PATENT DOCUMENTS

| | | | |
|---|---|---|---|
| 3,857,279 | 12/1974 | Salzer et al. | 73/67.2 |
| 3,865,201 | 2/1975 | Haden | 73/151 |
| 3,872,285 | 3/1975 | Shum et al. | 235/151.11 |
| 3,876,016 | 4/1975 | Stinson | 175/45 |
| 3,916,684 | 11/1975 | Rundell | 73/151.5 |
| 4,064,749 | 12/1977 | Pittman et al. | 73/152 |
| 4,087,801 | 5/1978 | Noh | 340/267 R |
| 4,150,568 | 4/1979 | Berger et al. | 73/151 |
| 4,207,567 | 6/1980 | Juengel et al. | 340/680 |
| 4,260,986 | 4/1981 | Kobayashi et al. | 340/680 |
| 4,346,591 | 8/1982 | Evans | 73/151 |
| 4,413,507 | 11/1983 | Drew et al. | 73/104 |
| 4,429,578 | 2/1984 | Darrel et al. | 73/659 |
| 4,441,103 | 4/1984 | Urabe | 340/680 |

(List continued on next page.)

FOREIGN PATENT DOCUMENTS

| | | |
|---|---|---|
| 1401113 | 7/1975 | United Kingdom . |
| 1439519 | 6/1976 | United Kingdom . |
| 1441948 | 7/1976 | United Kingdom . |

(List continued on next page.)

OTHER PUBLICATIONS

*Forces and Motions,* ASM Publication: Journal of Engineering for Industry, p. 217 (May 1968).

C. E. Miller and H. M. Rollins, *Evaluation of a Vibration Damping Tool and of Drill Stem Torque Requirement from Data Recorded by an Instrumented Drill Stem Member,* ASME Publication: Journal of Engineering for Industry, p. 226 (May 1968).

F. S. Young, Jr., *Computerized Drilling Control,* vol. 246 of Transactions, (1969).

L. Kreisle and J. Vance, *Mathematical Analysis of the Effect of a Shock Sub on the Longitudinal Vibrations of an Oil Well Drill String,* Society of Petroleum Engineers Journal, (Dec. 1970).

S. Luta, M. Raynaud, S. Gatalder, C. Quichand and J. Raynal, *Dynamic Theory of Drilling and Instantaneous Logging,* American Institute of Mining, Metallurgic, and Petroleum Engineers, Inc., SPE Paper No. 3604, (1971).

S. Gibbs and K. Nolen, *Wellsite Diagnosis of Pumping Problems Using Mini Computer,* Journal of Petroleum Technology, (Nov. 1973).

E. B. Denison, *Downhole Measurements Through Modified Drill Pipe,* Journal of Pressure Vessel Technology, (May 1976).

V. I. Ibragimov, *Solving Reverse Problem of Determination of Forces Acting on Bits in the Process of Drilling by Means of Mount Recordings of Vibrations Using Probabilistic–Statistical Methods,* Izv Vyssh Uchebn Zaved Neft Gaz, (Jul. 1976) (Abstract Only).

W. J. McDonald, *Borehold Data Telemetry During Drilling,* Erdoel Erdgas Z, (Aug. 8, 1976) (Abstract Only).

M. G. Willcox, A. P. Karle and H. R. Chavez, *Obtaining Optimum Performance from Down Hole Shock Absorbing Tool,* Drilling Technology Conference of the International Association of Drilling Contractors, (Mar. 1977).

E. B. Denison, *Shell's High–Data–Rate Drilling Telemetry System Passes First Test,* Oil and Gas Journal, (Jun. 13, 1977).

B. Kutuzov and T. Dozorov, *Monitoring Drilling Tool Conditions by Acoustic Vibrations Generated by Its Operation,* Izv Vyssh Uchebn Zaved Gorn Zh, (Dec. 1977).

E. B. Denison, *High Data Rate Drilling Telemetry System,* Journal of Petroleum Technology, (Feb. 1979).

D. Tanguy and W. Zoeller, *Applications of Measurement While Drilling,* Society of Petroleum Engineers, SPE Paper No. 10324, (Oct. 1981).

N. Sadiev, A. Amraliev, V. Baranofskii, and M. Gamidov, *Problem of Acoustic Control in the Rotor Drilling Process Control System,* Izv Vyssh Uchebn Zaved Neft Gas, (NOv. 11, 1981) (Abstract Only).

Kenneth W. Yee and Donald S. Blomquist, *An On–Line Method of Determining Tool Wear by Time Domain Analysis,* Society of Manufacturing Engineers, Technical Paper, (1982).

A. W. Kamp, *Downhole Telemetry from the User's Point of View,* Society of Petroleum Engineers, SPE Paper No. 11227, (Sep. 1982).

M. Gamidov, *Problem of Control Depth Parameters in Rotary Drilling,* Izv Vyssh Uchebn Zaved Neft Gaz, (Mar. 3, 1983).

A. Orlov and S. Orlov, *Calculation of the Optimal Drilling Regime,* Neft Khoz, (Apr. 4, 1983) (Abstract Only).

J. L. Rose, M. C. Fuller, J. B. Nestleroth and Y. H. Jeong, *An Ultrasonic Global Inspection Technique for an Offshore K–Joint,* Society of Petroleum Engineers Journal, (Apr. 1983).

D. Grosso, J. Raynal, and D. Rader, *Report on MWD Experimental Downhole Sensors,* Journal of Petroleum Technology, (May 1983).

W. Gravley, *Review of Downhole Measurement While Drilling systems,* Journal of Petroleum Technology, (Aug. 1983).

B. Breslav and I. Gutman, *Determination of Supercritical Rotation Frequencies of Rolling Cutter Bits,* Neft Khoz, (Oct. 10, 1983). (Abstract Only).

Don W. Dareing, *Vibrations Increase Available Power at the Bit,* Oil and Gas Journal, (Mar. 5, 1984).

Don W. Dareing, *Drill Collar Length is a Major Factor*

(List continued on next page.)

U.S. PATENT DOCUMENTS

| | | | |
|---|---|---|---|
| 4,441,444 | 4/1984 | Jung | 112/311 |
| 4,445,578 | 5/1984 | Millheim | 175/45 |
| 4,471,444 | 9/1984 | Yee et al. | 364/475 |
| 4,507,735 | 3/1985 | Moorehead et al. | 364/422 |
| 4,514,797 | 4/1985 | Begin | 364/148 |
| 4,549,431 | 10/1985 | Soelinah | 73/151 |
| 4,558,311 | 12/1985 | Forsgren et al. | 340/680 |
| 4,559,600 | 12/1985 | Rao | 364/474 |
| 4,614,117 | 9/1986 | Taniguti | 73/659 |
| 4,616,321 | 10/1986 | Chan | 364/422 |
| 4,627,276 | 12/1986 | Burgess et al. | 73/151 |
| 4,636,779 | 1/1987 | Thomas et al. | 340/680 |

(List continued on next page.)

FOREIGN PATENT DOCUMENTS

| | | |
|---|---|---|
| 2133881 | 8/1984 | United Kingdom . |
| 366483 | 3/1973 | U.S.S.R. . |
| 607003 | 5/1978 | U.S.S.R. . |
| 730958 | 4/1980 | U.S.S.R. . |

(List continued on next page.)

OTHER PUBLICATIONS

*in Vibration Control,* Journal of Petroleum Technology, (Apr. 1984).

Will Honeybourne, *Formation MWD Benefits Evaluation and Efficiency,* Oil and Gas Journal, (Feb. 25, 1985).

Robert F. Mitchell and Michael B. Allen, *Lateral Fibration: The Key to BAHA Failure Analysis,* World Oil, (Mar. 1985).

D. K. Ma and S. L. Yang, *Kinematics of the Cone Bit,* Society of Petroleum Engineers Journal, (Jun. 1985).

Tom Guidry, *Data Acquisition system Cuts Drilling Cost, Oil and Gas Journal, (Aug. 5, 1985).*

S. F. Wolf, M. Zachsenhouse and A. Arian, *Field Measurements of Downhole Drillstring Vibration,* Society of Petroleum Engineers Paper, (Sep. 22–25 1985).

D. R. Thompson and Larry Dunlap, *Computer System Controls Mud During Kick Kill,* Oil and Gas Journal, (Nov. 25, 1985).

I. G. Falconer, T. M. Burgess and T. E. Wolfenberger, *MWD Interpretation Tracks Bit Wear,* Oil and Gas Journal, (Feb. 10, 1986).

John E. Fontenot, *Measurement While Drilling A New Tool,* Journal of Petroleum Technology, (Feb. 1986).

A. Johnson, T. R. Edwards and M. F. Miller, *MWD Efficiency Model Provides Real Time Answers,* Oil and Gas Journal, (Oct. 26, 1987).

S. Palumbo, C. D. Hawkins, S. M. Riley and G. J. Williams, *Research Well Monitoring Focus on Gumbo Problem,* Oil and Gas Journal, (Jan. 4, 1988).

L. R. Aalund, *Oil Industry Organized to Exploit Computing for its Basis Operations,* Oil and Gas Journal, (Jan 11, 1988).

M. Vikram Rao and J. E. Fontenot, *Many Factors Determine Need for Real Time or Recorded Data,* Oil and Gas Journal, (Jan. 25, 1988).

M. V. Rao and J. E. Fontenot, *MWD Gains as Formation Evaluation Tool,* Oil and Gas Journal, (Feb. 8, 1988).

J. E. Fontenot and M. V. Rao, *MWD Can Improve Well Safety, Control,* Oil and Gas Journal, (Feb. 15, 1988).

J. E. Fontenot and M. V. Rao, *MWD Aids Vital Drilling Decisions,* Oil and Gas Journal, (Mar. 14, 1988).

E. T. Koskie, Jr., D. Slagel, W. Lesso, Jr., *Monitoring MWD Torque Improve PDC Bit Penetration Rates,* World Oil, (Oct. 1988).

Warren Jones, *Unusual Stresses Require Attention to Bit Selection,* Oil and Gas Journal, (Oct. 22, 1990).

Steven Collins, *Pinpoint Rotating Machinery Problems by Color Mapping,* Power (Mar. 1991).

S. T. Chen and E. A. Eriksen, *Record P–and S–Waves In Cased or Open Wellbores,* World Oil, (Jul. 1991).

SU–1191–565–A, *Borehole Drilling Tool Faults Prevention While Drilling.* Nov. 15, 1985).

Bending Vibration of Rotating Drill Strings, dissertation of Rong–Juin Shyu, Massachusetts Institute of Technology, Aug. 1989, pp. 1–145.

Downhole Measurement Of Drill String Forces And Motions, F. H. Deily et al. ASME Journal of Engineering for Industry, May 1968, pp. 217–225.

The effect of a Down Hole Shock Absorber on Drill Bit and Drill Stem Performance, W. R. Garrett ASME Paper No. 62–PET–21, Jul. 1962, pp. 1–11.

Analysis of Downhole Measurements of Drill String Forces and Motions, R. A. Cunningham ASME Journal of Engineering for Industry, May 1968, pp. 208–216.

An Analytical Study of Drill–String Vibration, J. J. Bailey et al., ASME Journal of Engineering for Industry, May 1960, pp. 122–128.

High Data–Rate Drilling Telemetry System, E. B. Denison, Journal of Petroleum Technology, Feb. 1979, pp. 155–163.

Drilling optimized by monitoring BHA dynamics with MWD, D. Sim et al., Oil & Gas Journal, Mar. 1991, pp. 41–45.

Dynamic Theory of Drilling and Instantaneous Log- (List continued on next page.)

U.S. PATENT DOCUMENTS

| | | | |
|---|---|---|---|
| 4,636,780 | 1/1987 | Thomas et al. | 340/680 |
| 4,642,617 | 2/1987 | Thomas et al. | 340/680 |
| 4,644,335 | 2/1987 | Wenn | 340/683 |
| 4,671,366 | 6/1987 | Uitto et al. | 175/27 |
| 4,683,542 | 7/1987 | Taniguti | 364/508 |
| 4,685,329 | 8/1987 | Burgess | 73/151 |
| 4,695,957 | 9/1987 | Peitier | 364/422 |
| 4,715,451 | 12/1987 | Bseisu et al. | 73/151 |
| 4,760,735 | 8/1988 | Sheppard et al. | 73/151 |
| 4,791,998 | 12/1988 | Hempkins et al. | 175/61 |
| 5,181,172 | 1/1993 | Whitten | 73/151 |

FOREIGN PATENT DOCUMENTS

| | | |
|---|---|---|
| 899884 | 1/1982 | U.S.S.R. . |
| 909139 | 2/1982 | U.S.S.R. . |
| 972065 | 11/1982 | U.S.S.R. . |
| 11915A | 11/1985 | U.S.S.R. . |

OTHER PUBLICATIONS ging, J. Luta et al., Society of Petroleum Engineers Paper No. 3604. Oct. 1971.

The Genesis of Torsional Drillstring Vibrations, J. Ford Brett, Society of Petroleum Engineers, Sep. 1992, pp. 168–174.

Drill Collar Length Is A Major Factor in Vibration Control, Don W. Dareing, Society of Petroleum Engineers Paper No. 11228, Sep. 1982.

Detection of Various Drilling Phenomena Utilizing High Frequency Surface Measurements, A. A. Besalsow et al., Society of Petroleum Engineers Paper No. 14327, Sep. 1985.

Field Measurements of Downhole Drillstring Vibrations, S. F. Wolf et al., Society of Petroleum Engineers Paper No. 14330, Sep. 1985.

Case Studies of BHA Vibration Failure, R. F. Mitchell et al., Society of Petroleum Engineers Paper No. 16675, Sep. 1987, pp. 237–259.

Measurement of BHA Vibration Using MWD, D. A. Close et al., IADC/SPE Paper No. 17273 Mar. 1988, pp. 659–667.

Detection and Monitoring of the Slip–Stick Motion: Field Experiments, H. Henneuse et al., SPE/IADC Paper No. 21945, Mar 1991, pp. 429–438.

A Unified Approach to Drillstem Failure Prevention, T. H. Hill et al., SPE/IADC Paper No. 22002, Mar. 1991, pp. 857–870.

The Use of Real–Time Downhole Shock Measurements To Improve BHA Component Reliability, S. D. Alley et al., Society of Petroleum Engineers Paper No. 22537, Oct. 1991, pp. 19–24.

Detection of BHA Lateral Resonances While Drilling With Surface Longitudinal and Torsional Sensors P. R. Paslay et al., Society of Petroleum Engineers Paper No. 24583, Oct. 1992, pp. 365–372.

Directional and Stability Characteristics of Anti–Whirl Bits With Non–Axisymmetric Loading, P. E. Pastusek et al., Society of Petroleum Engineers Paper No. 24614, Oct. 1992, pp. 727–740.

M. R. Annis, P. H. Monaghan,. "Differential Pressure Sticking–Laboratory Studies of Friction Between Steel and Mud Filter Cake", SPE Paper No. 151, pp. 337–343, May 1963.

J.P. Simpson, "The Role of Oil Mud in Controlling Differential–Pressure Sticking of Drill Pipe", SPE Paper No. 361, pp. 1–16, Apr. 1962.

H. D. Outmans, "Mechanics of Differential Pressure Sticking of Drill Collars", SPE Paper No. 963–G, pp. 365–374, 1958.

D. J. Vidrine, E. J. Benit, "Field Verification of the Effect of Differential Pressure on Drilling Rate", SPE Paper No. 1859, pp. 676–682, 1968.

Neal Adams, "A Field Case Study of Differential–Pressure Pipe Sticking", SPE Paper No. 6716, 1977.

T. E. Love, "Stickiness Factor–A New Way of Looking at Stuck Pipe", SPE Paper No. 11383, pp. 225–231, 1983.

R. H. Kingsborough and W. E. Lohec, "Multivariate Statistical Analysis of Stuck Drillpipe Situations", SPE Paper No. 14181, pp. 1–10, 1985.

J. M. Courteille and C. Zurdo, "A New Approach to Differential Sticking", SPE Paper No. 14244, pp. 1–10, 1985.

R. R. Weakley, "Use of Stuck Pipe Statistics to Reduce the Occurrence of Stuck Pipe", SPE Paper No. 20410, pp. 59–66, 1990.

R. K. Clark and S. G. Almquist, "Evaluation of Spotting Fluids in a Full–Scale Differential Pressure Sticking Apparatus", SPE Paper No. 22550, pp. 157–167, 1991.

171
AXIAL ACCELERATION
0.35
0.30
0.25
0.20
0.15

173
TORSIONAL ACCELERATION
CONNECTION
CONNECTION AND WORK PRE
0.5
0.4
0.2

175
RATIO . AXIAL
1.4
1.2
1.0
0.8
0.6
0.4

50
100
150
200
TIME (MINUTES)

METHOD AND APPARATUS FOR DETECTING IMPENDING STICKING OF A DRILLSTRING

BACKGROUND OF THE INVENTION

1. Field of the Invention

The present invention relates in general to techniques for drilling oil and gas wellbores, and in particular to techniques for detecting and preventing sticking of a drillstring in a wellbore during drilling operations.

2. Description of the Prior Art

During drilling operations in oil and gas wells, it is not uncommon for the drillstring to become stuck within the well to such a degree that it can no longer be raised, lowered, or rotated. There are a number of different causes which result in drillstring sticking including: (1) collapse of the borehole about a portion of the drillstring; (2) the settling of cuttings about the drillstring; (3) the accumulation of mud filter cake during prolonged interruption of circulation of the drilling fluid; and (4) sticking of the drillstring against a portion of the borehole by force of the pressure of the mud column, which is known in the industry as "differential pressure sticking".

Differential pressure sticking is thought to occur when a portion of the drillstring rests against a portion of the borehole wall, and imbeds itself in the filter cake and in contact with a permeable bed. The portion of the drillstring which is in contact with the filter cake is then sealed from the full hydrostatic pressure of the mud column. The pressure difference between the mud column and the formation pressure of the adjoining formation acts on the area of the drill pipe in contact with the filter cake to hold the drill pipe against the wall of the borehole. Frictional engagement between the drill pipe and the borehole filter cake prevents axial or rotational movement of the drill pipe. This theory of differential pressure sticking was first proposed by W. E. Helmick and A. J. Longley in "Pressure-Differential Sticking of Drill Pipe and How it Can Be Avoided", *Drilling and Production Practice,* (1957), and has been verified in numerous laboratory tests.

No effective technique exists in the prior art for accurately predicting the onset of pipe sticking in general, and differential pressure sticking in particular. However, several attempts have been made to develop systems for predicting impending pipe sticking, and these should be mentioned in passing.

In the Society of Petroleum Engineers Paper No. SPE 11383, entitled "Stickiness Factor—A New Way of Looking at Stuck Pipe" by T. E. Love, of Exxon Company U.S.A., a formula is set forth by the author for calculating a "stickiness" factor which is empirically based upon the maximum angle of the open hole in degrees, the amount of open hole in feet, the mud weight in pounds per gallon, and the API fluid loss amount in cubic centimeters per thirty minutes, as well as the length of the bottom hole assembly in feet. The article includes a plot which shows the statistical relationship between the stickiness factor and (a) the occurrence of stuck pipe and (b) the chance of freeing stuck pipe. While the author proposes daily calculation of the stickiness factor to determine when a risk of differential pressure sticking exists, he admits that the formula is based upon a limited study of offshore wells in the Gulf of Mexico, and that it may not necessarily apply to wells in other geographic areas. Furthermore, he states that the stickiness factor "does not predict when pipe will stick, but simply predicts the chance of freeing pipe that has already been stuck." He also states that the stickiness factor may be useful in evaluating the use of lubricants ("spotting fluids") and retrieval operations ("fishing" operations) by providing an indication of the chance of success of these operations in freeing stuck pipe. Finally, he states that maintaining a reduced stickiness factor should reduce the chances of sticking pipe.

In the Society of Petroleum Engineers Paper No. SPE 14181, entitled "Multivariate Statistical Analysis of Stuck Drill Pipe Situations", the authors, R. H. Kingsborough, W. E. Lohec, W. B. Hempkins, and C. J. Nini, propose that a multivariate statistical analysis of as many as twenty (20) commonly reported drilling parameters be performed utilizing data from stuck drill pipe situations to provide probability contour maps which can be utilized to develop optimization routines which maintain operating parameters in a safe range to avoid the possibility of a pressure differential sticking of the drillstring.

In the Society of Petroleum Engineers Paper No. SPE 20410, entitled "Use of Stuck Pipe Statistics to Reduce the Occurrence of Stuck Pipe", by R. R. Weekly, of Chevron Services, Inc., the author recommends the use of statistics on stuck pipe occurrences to reduce the occurrence of pipe sticking in wells. More particularly, over six hundred Gulf Coast wells were analyzed, including trouble-free wells and wells which experienced differential sticking and mechanical sticking. Environments were identified which are likely to have a high risk of stuck pipe occurrence. Risk factors were also identified to allow engineering design of the well to avoid high risk situations.

None of these prior art approaches provide a general technique for determining, in advance of sticking, that sticking is about to occur. Thus, these approaches do not provide any type of general purpose warning system which can be utilized to avoid sticking. The avoidance of sticking of a drillstring within a wellbore is of paramount importance. It is frequently difficult, and sometimes impossible, to free a drillstring from a stuck position. Millions of dollars of resources are wasted annually in recovery and retrieval operations as a result of differential and other sticking of the drillstring within the wellbore. If the drillstring cannot be retrieved from the wellbore, side tracking drilling operations must be performed to drill around the drillstring. In some cases the well must be abandoned when remedial efforts fail or prove to be too costly. It is clearly unsatisfactory to determine that sticking may be a problem after sticking of the drillstring has occurred already, since no time would remain to allow remedial action. There is a great industry need for techniques for accurately determining that sticking is impending, far in advance of the occurrence of actual sticking, to allow a sufficient time interval in order to take corrective or remedial actions by altering one or more of the drilling conditions.

The most common types of remedial actions include the alteration of one or more drilling fluid properties, such as drilling fluid type (water based drilling fluids versus oil based drilling fluids), drilling fluid density, drilling fluid viscosity, drilling fluid flow rates, and solid particle content of the drilling fluid. Additionally, lubricants can be added to the drilling fluid to minimize the possibility of differential sticking. Finally, the frequency and amount of drillstring movement, including axial movement of the drillstring and rotational movement of the drillstring, can minimize or deter differential sticking.

A broad overview of the theory of differential pressure sticking, as well as conventional techniques for avoiding or minimizing the occurrence of differential pressure sticking, can be found in the literature, including the following articles, which are incorporated herein by reference as if fully set forth:

(1) Society of Petroleum Engineers Paper No. 151, entitled "Differential Pressure Sticking—Laboratory Studies of Friction Between Steel and Mud Filter Cake", authored by M. R. Annis and P. H. Monaghan;

(2) Society of Petroleum Engineers Paper No. 361, entitled "The Role of Oil Mud in Controlling Differential-Pressure Sticking of Drill Pipe", authored by Jay P. Simpson;

(3) Society of Petroleum Engineers Paper No. 963-G, entitled "Mechanics of Differential Pressure Sticking of Drill Collars", authored by H. D. Outmans;

(4) Society of Petroleum Engineers Paper No. 1859, entitled "Field Verification of the Effect of Differential Pressure on Drilling Rate", authored by D. J. Vidrine and E. J. Benit;

(5) Society of Petroleum Engineers Paper No. 6716, entitled "A Field Case Study of Differential- Pressure Pipe Sticking", authored by Neal Adams;

(6) Society of Petroleum Engineers Paper No. 11383, entitled "Stickiness Factor—A New Way of Looking at Stuck Pipe", authored by T. E. Love;

(7) Society of Petroleum Engineers Paper No. 14181, entitled "Multivariate Statistical Analysis of Stuck Drillpipe Situations", authored by R. H. Kingsborough, W. E. Lohec, W. B. Hempkins, and C. J. Nini;

(8) Society of Petroleum Engineers Paper No. 14244, entitled "A New Approach to Differential Sticking", authored by J. M. Courteille and C. Zurdo;

(9) Society of Petroleum Engineers Paper No. 20410, entitled "Use of Stuck Pipe Statistics to Reduce the Occurrence of Stuck Pipe", authored by R. R. Weakley;

(10) Society of Petroleum Engineers Paper No. 21998, entitled "Operational Decision Making for Stuck Pipe Incidents in the Gulf of Mexico: A Risk Economics Approach", authored by R. M. Shivers III and R. J. Domangue;

(11) Society of Petroleum Engineers Paper No. 21999, entitled "A Task Force Approach to Reducing Stuck Pipe Costs", authored by W. B. Bradley, D. Jarman, R. S. Plott, R. D. Wood, T. R. Schofield, R. A. Auflick, and D. Cocking;

(12) Society of Petroleum Engineers Paper No. 22549, entitled "Differential Sticking Laboratory Tests Can Improve Mud Design", authored by Y. M. Bushnell-Watson and S. S. Panesar; and

(13) Society of Petroleum Engineers Paper No. 22550, entitled "Evaluation of Spotting Fluids in a Full-Scale Differential Pressure Sticking Apparatus", authored by R. K. Clark and S. G. Almquist.

SUMMARY OF THE INVENTION

It is one objective of the present invention to provide a method and apparatus for drilling a wellbore utilizing a drillstring, wherein a real-time property of the drilling operation is substantially continuously sensed and a signal representative of this real-time property is recorded, and monitored for a signal change to detect impending sticking before actual sticking occurs.

It is yet another objective of the present invention to provide a method of drilling a well utilizing a drillstring, wherein at least one drillstring characteristic is substantially continually sensed with respect to time, during selected drilling operations, and at least one signal representative of the drillstring characteristic is recorded and monitored for at least one signal characteristic which identifies impending sticking.

It is one objective of the present invention to provide a method and apparatus for determining that a drillstring in a wellbore is susceptible to sticking against a wellbore surface through monitoring of a vibration characteristic of the drillstring during drilling operations, and comparing the vibration characteristic with at least one prior vibration characteristic to identify impending sticking.

It is yet another objective of the present invention to provide a method and apparatus for detecting impending sticking of a drillstring in an oil and gas wellbore wherein a tubular assembly is provided for coupling in the drillstring at an upper location, which includes at least one sensor for detecting vibration in the drillstring, wherein one vibration characteristic is monitored and compared to previous vibration characteristics to determine impending sticking.

It is still another objective of the present invention to provide a method and apparatus for detecting impending sticking of a drillstring in an oil and gas wellbore, wherein a vibration characteristic of the drillstring is monitored during drilling operations, and subjected to a stabilizing signal conditioning operation to facilitate comparison with prior determinations of the vibration characteristic to ascertain impending sticking.

It is yet another objective of the present invention to provide a method and apparatus for detecting that a drillstring in a wellbore is susceptible to sticking against a wellbore surface by monitoring vibration amplitudes of vibrations in the drillstring during drilling operations, and comparing the vibration amplitudes with prior vibration amplitudes to identify amplitude changes which are characteristic of impending sticking.

It is still another objective of the present invention to provide a method and apparatus for determining that a drillstring in a wellbore is susceptible to sticking against a wellbore surface during drilling operations, wherein at least one of (1) axial vibration, and (2) torsional vibration are monitored during drilling operations and compared to previous values to detect amplitude changes which are characteristic of impending sticking.

These and other objectives are achieved as is now described. Viewed broadly, the present invention is directed to a method and apparatus for drilling a wellbore utilizing a drillstring, wherein a real-time property of a drilling operation, such as at least one drillstring characteristic, is substantially continuously sensed, and at least one signal representative of the real-time property is recorded to allow monitoring of a signal change which is indicative of impending pipe sticking, before actual sticking occurs.

When characterized broadly as a method, the present invention is directed to a method of determining that a drillstring in a wellbore is susceptible to sticking against a wellbore surface and includes the steps of (1) monitoring a vibration characteristic of the drillstring during drilling operations, and (2) comparing tile vibration characteristic with at least one prior vibration characteristic to identify impending sticking. More particularly, in the preferred embodiment of the present invention, vibration amplitudes are compared with prior vibration amplitudes to identify amplitude changes which are characteristic of impending sticking.

In the preferred embodiment of the present invention, a tubular assembly is provided with at least one vibration sensor disposed therein. The tubular subassembly is placed in the drillstring, preferably in an upper location. A vibration characteristic of the drillstring is monitored during drilling operations with the vibration sensors. In the preferred embodiment, the output of the vibration sensors is subjected to a stabilizing signal conditioning operation which preferably normalizes the output of the vibration sensor and reduces the impact of noise. In the particular embodiment described herein, accelerometer-type or strain-gauge-type vibration sensors are utilized to detect both axial and torsional vibration.

It is been determined that the axial vibration is most indicative of impending pipe sticking, although torsional vibration can also be utilized to detect impending sticking far in advance of actual sticking of the drillstring. It has also been determined that a signal indicative of the ratio of axial and torsional vibration can be utilized to predict that a drillstring is susceptible to sticking. In the preferred embodiment, the output of the stabilizing signal processing operation is displayed, or printed, for operator inspection in a time-domain format which allows the comparison of current vibration amplitudes with previous vibration amplitudes. In the preferred embodiment, a gradual degradation of axial vibration amplitudes for a time period prior to the occurrence of sticking indicates the onset of sticking. In alternative embodiments, a gradual decrease in the amplitude of a signal indicative of the ratio of axial vibration to torsional vibration can be used to identify impending sticking. In still other embodiments, increases in the amplitude of a signal indicative of torsional vibration can be used to detect that sticking is impending. The operator may take corrective action to prevent the sticking by conventional remedial actions such as altering the composition of the drilling fluid, altering the axial position of the drillstring, or altering the speed rotation of the drillstring, or performing any other activity which is known in the art for preventing, or minimizing the possibility of, sticking of the drillstring within the wellbore.

Additional objectives, features and advantages will be apparent in the written description which follows.

BRIEF DESCRIPTION OF THE DRAWINGS

The novel features believed characteristic of the invention are set forth in the appended claims. The invention itself, however, as well as a preferred mode of use, further objectives and advantages thereof, will best be understood by reference to the following detailed description of an illustrative embodiment when read in conjunction with the accompanying drawings, wherein:

DETAILED DESCRIPTION OF THE INVENTION

Figure 1:
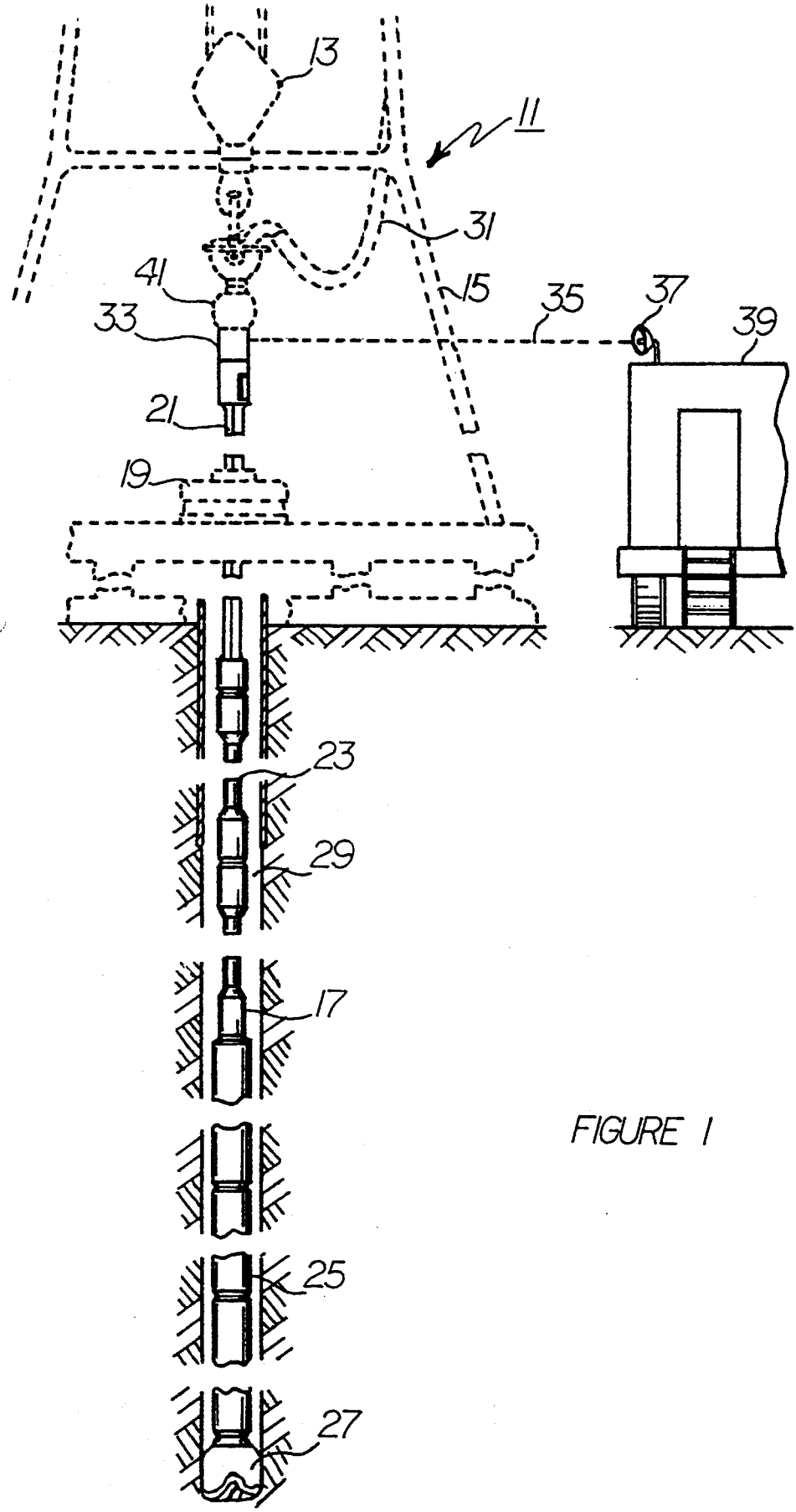
FIG. 1 is a combination of perspective, phantom, and longitudinal section view of an oil and gas well during drilling operations which is equipped with an apparatus for detecting impending drillstring sticking in accordance with the present invention.
Figure 2A:
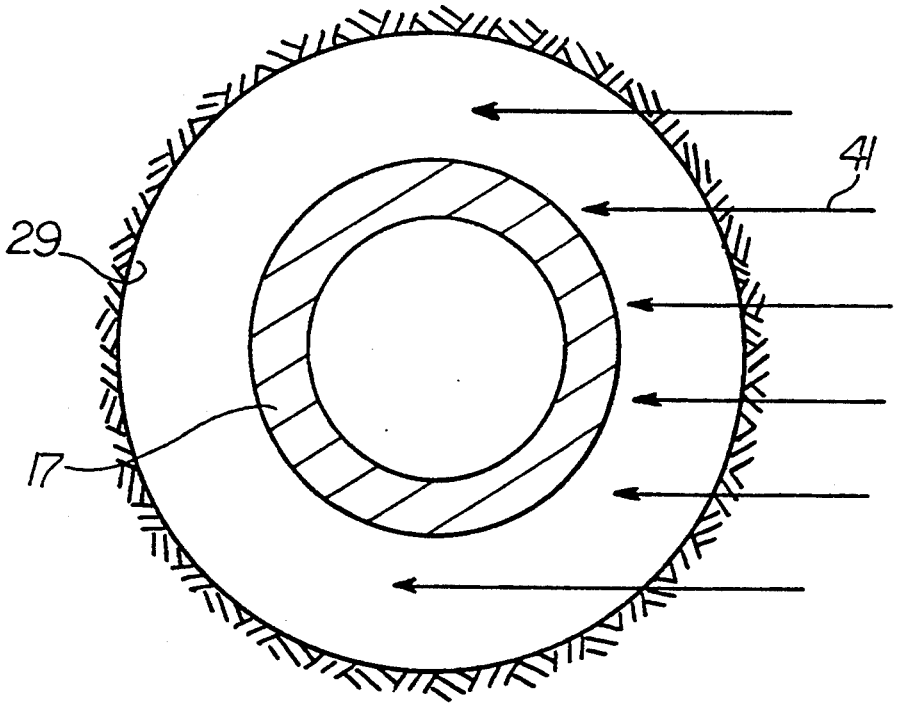
FIGS. 2*a* and 2*b* are cross section views of the wellbore and drillstring, and graphically depict differential pressure sticking of the drillstring in the wellbore.
Figure 2B:
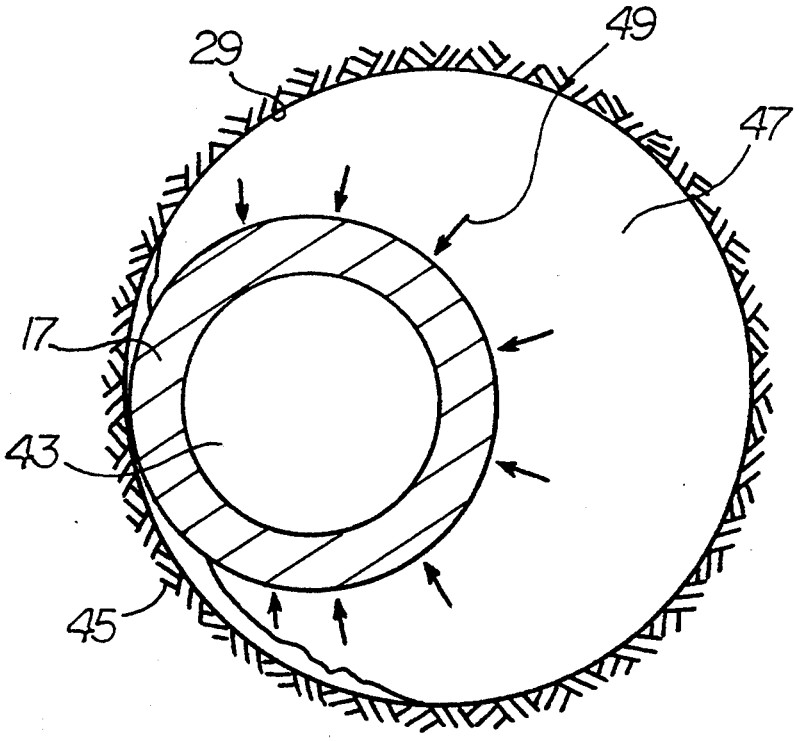

In FIG. 1, drilling rig 11 is depicted in phantom and includes traveling block 13 which is used to raise and lower drillstring 17 relative to derrick 15, and rotary table 19 which selectively engages drillstring 17 and rotates it within wellbore 29. Drillstring 17 includes a section of drill pipe 23 at its upper portion, and a section of drill collar 25 at its lower portion. Rock bit 27 is coupled to the lowermost end of drill collar 25, and includes cutting members for disintegrating the geologic formation at the bottom of wellbore 29. In FIG. 1, a rolling cone cutter type rockbit 27 is depicted, which includes three rotatable cone members, which rotate relative to the bit body, and include a plurality of cutting teeth disposed thereon for disintegrating geologic formations. Alternatively, a fixed cutter, or "drag" bit, may be utilized. This type of cutter includes no rotating cones, and instead includes a plurality of cutting compacts, typically including a diamond portion, distributed upon the outer surface of the bit body.

In conventional drilling operations, a stream of drilling fluid, also referred to as "mud", is directed downward through drillstring 17 and rockbit 27 to cool and lubricate rockbit 27, and carry cuttings to the surface through the annular fluid column which surrounds drillstring 17. Preferably, drilling fluid is directed from a drilling fluid reservoir (not depicted), through conduit 31, through kelly 21, into the central bore of drillstring 17. It is jetted outward through nozzles provided in the body of rockbit 27.

In the preferred embodiment of the present invention, measurement subassembly 33 is coupled into drillstring 17 preferably, but not necessarily, at an upper location. In the view of FIG. 1, measurement subassembly 33 is shown coupled between kelly 21 and kelly swivel 41, and is utilized to substantially continually sense a real-time property of the drilling operations, and transmit data representative of that property via microwave link 35 to microwave receiver 37, which feeds the data stream into monitoring station 39 where it is recorded, and monitored for detection of a signal change which is indicative of impending sticking of the drillstring before actual sticking occurs. In the preferred embodiment, measurement subassembly 33 is utilized to measure vibration in drillstring 27 at or near the surface. Drillstring 17 acts as a vibration conductor which communicates vibration signals which arise from the drillstring and/or rockbit interaction with wellbore 29. While measurement subassembly 33 is shown disposed between kelly swivel 41 and kelly 21, in alternative embodiments, it may be possible or desirable to place measurement subassembly 33 within wellbore 29.

FIGS. *2a* and *2b* graphically depict, in simplified form, the occurrence of pressure differential sticking of drillstring 17 within wellbore 29. Typically, some force, such as differential pressure 42, within wellbore 29 urges a portion of drillstring 17 into contact with a surrounding portion of the wellbore wall of wellbore 29. This forces portion 43 into contact with a permeable formation 45. If a large pressure differential exists between fluid column 47 within wellbore 29 and permeable formation 45, a force 49 acts on all other portions of drillstring 17 to hold it in firm contact against the wellbore wall. If the amount of force applied to drillstring 17 is large and/or the amount of contact between drillstring 17 and the wellbore wall is large, the frictional contact between the wellbore and the drillstring, and hydrostatic pressure between the wellbore and the drillstring, will be so large that conventional hoisting equipment of drilling rig 11 will be inadequate for lifting drillstring 17. Additionally, conventional downward forces which can be applied to drillstring 17 will not move the drillstring downward. Finally, the rotary table of drilling rig 11 will not have sufficient force to rotate drillstring 17 within wellbore 29.

In this stuck condition, drilling operations must cease, and remedial operations must be undertaken to free the drillstring from the stuck condition. Fishing equipment can be utilized to attempt to fish drillstring 17 from wellbore 29. Alternatively, mud additives, such as lubricants, may be placed within fluid column 47, in an effort to reduce the coefficient of friction between drillstring 17 and wellbore 29. Alternatively, one or more drilling fluid attributes may be modified in an effort to reduce the amount of force acting upon drillstring 17, by reducing the pressure differential. Typically, the "weight" or density of the mud is altered in an effort to modify the hydrostatic force of fluid column 47. Many other conventional remedial measures can be taken to attempt to dislodge drillstring 17 from a stuck condition within wellbore 29. If conventional remedial measures fails, expensive side tracking drilling operations must be undertaken to bypass the stuck pipe. Many millions of dollars may be wasted in lost rig time, expensive fishing, jarring, and mud modification operations, as well as side tracking drilling operations in an effort to recover from a stuck drillstring condition.

As was discussed above, other conditions may also result in sticking of drillstring 27, such as the collapse of a portion of the wellbore about drillstring 27, or the accumulation of sedimentary particles in the annular region which settle about the bottom hole assembly and prevent its movement, but differential pressure sticking is a more widely encountered problem with a greater overall economic impact.

Figure 3:
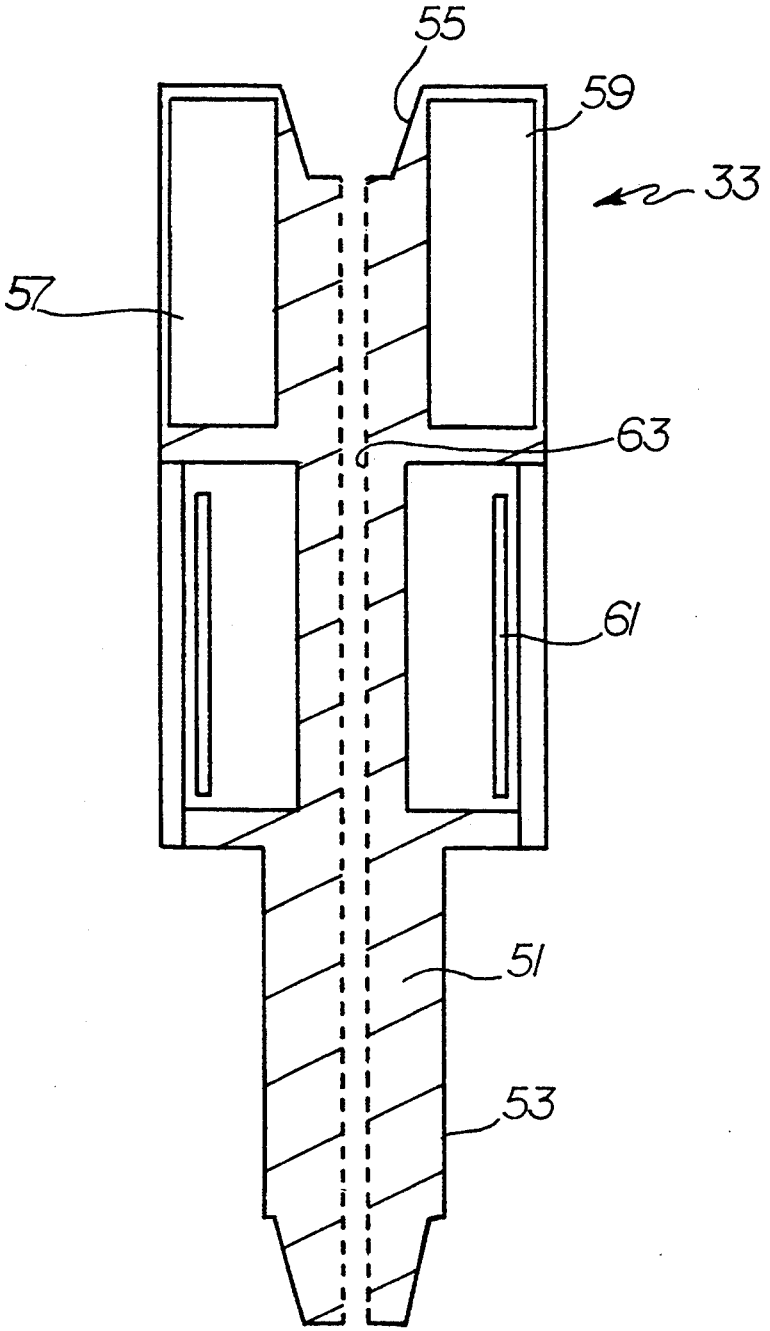
FIG. 3 is a combination block diagram and longitudinal section view of the preferred apparatus for detecting impending sticking of the present invention.
Figure 4:
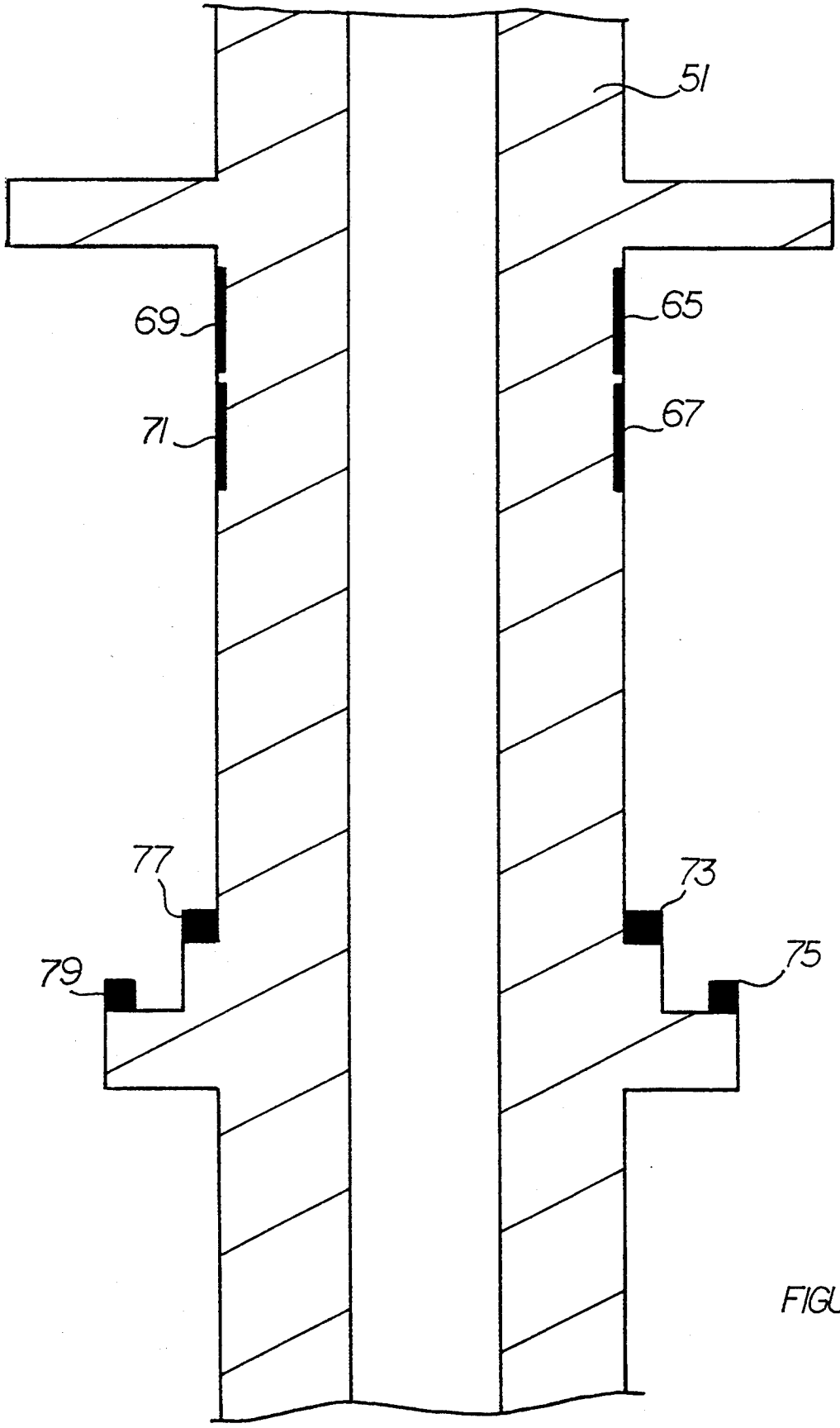
FIG. 4 is a detailed view of the apparatus of FIG. 3 which depicts sensor placement.
Figure 5:
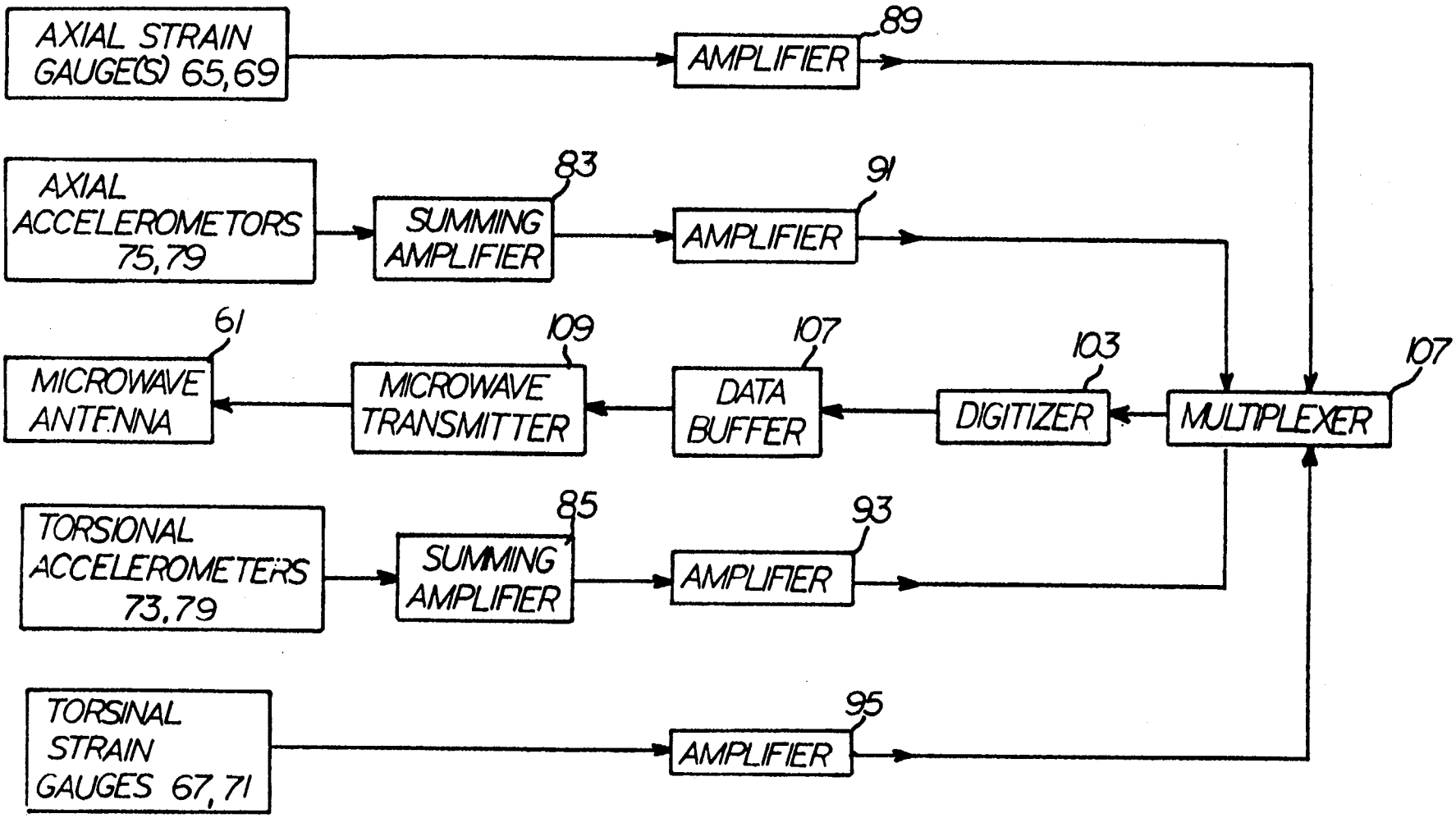
FIG. 5 is a block diagram view of the preferred apparatus for processing and transmitting data gathered by strain gauge sensors and accelerometers.

FIGS. 3, 4, and 5 will now be utilized to describe the components which make up measurement subassembly 33. With reference first to FIG. 3, measurement subassembly 33 includes subassembly body 51 which is preferably formed of steel, and which defines threaded pin end 53 at its lowermost section and threaded box end 55 (the threads are not depicted in FIG. 3) at its uppermost section (although any pin and box combination or orientation could be used). Measurement subassembly 33 is equipped with removable battery pack 57 which powers all the electrical components contained within subassembly 33. Measurement subassembly 33 further includes signal processing electronics 59 which receive data signals and communicate them to microwave transmitting antennae 61 which selectively radiates microwave communications encoded with a data stream representative of the vibration which is sensed in measurement subassembly 33. Measurement subassembly 33 is further equipped with central bore 63 which extends from threaded box end 55 to threaded pin end 53 (the threads are not depicted in FIG. 3), and which serves to allow for the communication of drilling fluid downward from kelly swivel 41 (not depicted in this figure, but depicted in FIG. 1) through kelly 21 to drillstring 17.

With reference now to FIG. 4, in the preferred embodiment of the present invention, measurement subassembly 33 is equipped with the plurality of sensors capable of substantially continuously sensing a real-time property of the drilling operations. In the preferred embodiment of the present invention, the real time property of drilling operations which is measured is vibration. In the preferred embodiment, four strain gauge sensors 65, 67, 69, 71 are provided along with four accelerometers 73, 75, 77, 79. Preferably, two of the strain gauge sensors 65, 69 are oriented to detect axial strain within subassembly body 51 which is indicative of the drillstring 17 and/or rockbit 27 interaction with wellbore 29. Additionally, strain gauges 67, 71 are oriented to detect torsional strain within subassembly body 51 which is likewise indicative of the drillstring 17 and/or rockbit 27 interaction with wellbore 29. In addition, accelerometers 73, 75, 77, 79, are also located within measurement subassembly 33 for detection of acceleration of subassembly body 51 in response to the interaction between drillstring 17 and/or rockbit 27 with wellbore 29. In the preferred embodiment of the present invention, accelerometers 73, 77 are provided for measurement of torsional acceleration of subassembly body 51. Also, in the preferred embodiment of the present invention, accelerometers 75, 79 are provided for detection of axial acceleration of subassembly body 51 of measurement subassembly 33.

In the preferred embodiment of the present invention, Model No. S/A9P-100-300, semiconductor-type strain gauges manufactured by Kulite of Lenoie, N.J., are arranged in an electrical wheatstone bridge configuration to allow measurement of both the axial and torsional strain in subassembly body 51. Also, in the preferred embodiment of the present invention, Model No. ESAXT-259 and ESAXT-2509 accelerometers manufactured by Entran of Fairfield, N.J., are provided for measurement of the axial and torsional acceleration of subassembly body 51.

The signal processing operations which are performed upon the data sensed by strain gauges 65, 67, 69, 71 and accelerometers 73, 75, 77, 79 are depicted in block diagram form in FIG. 5. As is shown therein, the outputs of axial strain gauges 65, 69 are directed to amplifier 89. The outputs of axial accelerometers 75, 79 are directed to summing amplifier 83. The outputs of torsional accelerometer 73, 77 are directed to summing amplifier 85. The outputs of torsional strain gauges 67, 71 are directed to amplifier 95. Summing amplifiers 83, 85 operate to simultaneously add and amplify the output signals of the various sensors. The outputs of summing amplifiers 83, 85, are directed to amplifiers 91, 93, respectively, for further amplification. In the preferred embodiment of the present invention, the vibration data from the sensors is sampled at a rate of 2,083 samples per second per channel. Also, preferably, anti-aliasing filters are used prior to sampling to ensure a non-aliased measurement in a 500 Hertz bandwidth (from 0 Hertz to 500 Hertz). The outputs of amplifiers 89, 91, 93, 95, are directed to multiplexer 105 which multiplexes the sensor data and transfers it to digitizer 103. Data buffer 107 then stores the data for use by microwave transmitter 109 which energizes omni-directional microwave antenna 61 for transmission of a data stream in microwave form from measurement subassembly 33 to microwave receiver 37 at monitoring station 39, for further processing of the data stream. In the present invention, data is transmitted over the microwave linkage at a rate of 200 kilobits per second, so a large amount of data is provided for analysis.

In the preferred embodiment of the present invention, the microwave communication system is preferably a Model No. TBT-50-25TL transmitter and a Model No. TBR-200-TL receiver manufactured by B. M. S. of San Diego, Calif. Also, in the preferred embodiment of the present invention, summing amplifiers 83, 85, are Model No. D51762510-C summing amplifiers manufactured by Exlog, Inc., of Houston, Tex.; amplifiers 89, 91, 93, 95 are Model No. 760PC2 amplifiers manufactured by Metraplex of Frederick, Md.; digitizer 103 is a Model No. 760AD1 analog-to-digital converter manufactured by Metraplex of Frederick, Md.; and the multiplexer 105 is a Model No. 760AD1 multiplexer manufactured by Metraplex of Frederick, Md.

Figure 6:
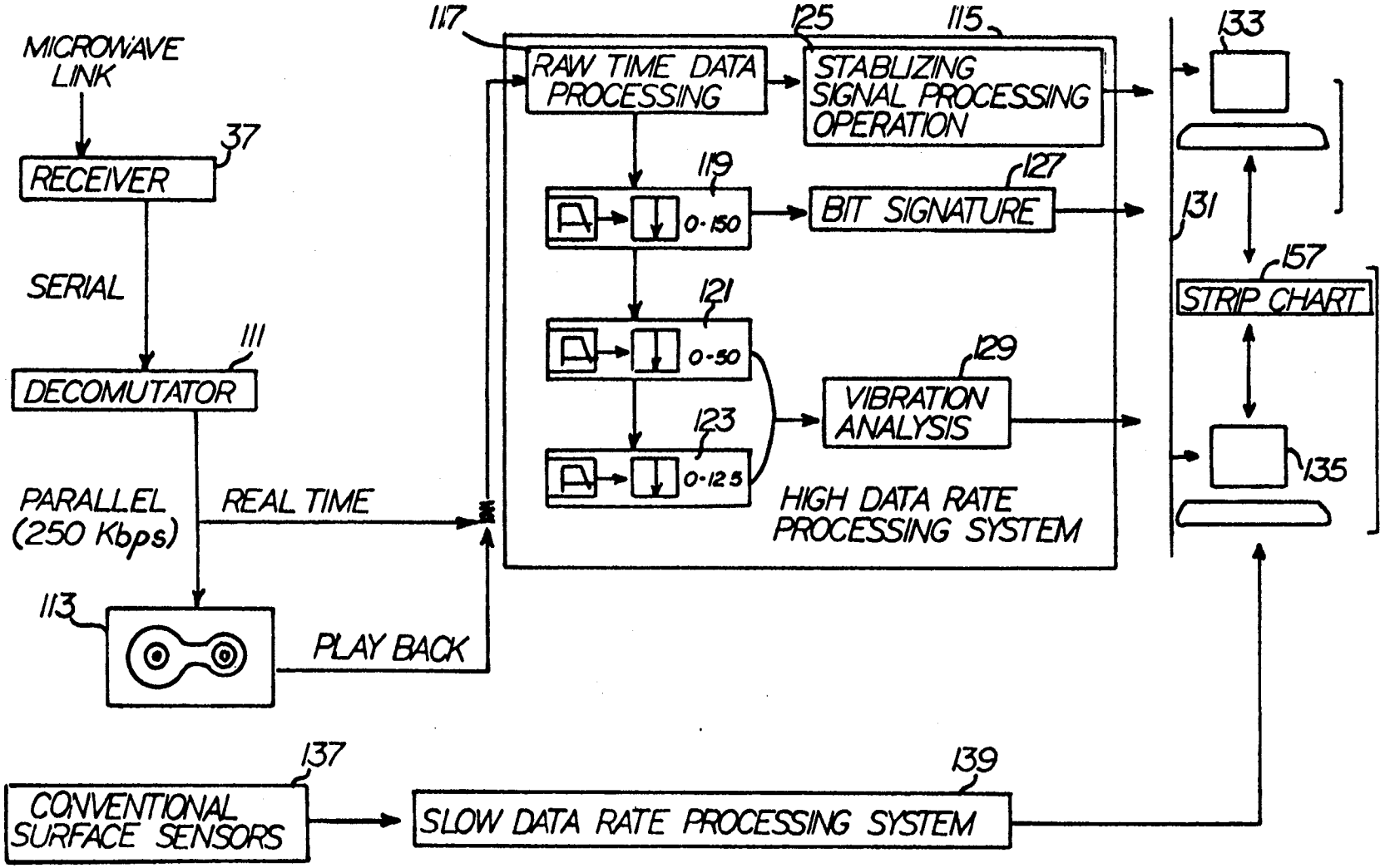
FIG. 6 is a block diagram view of the preferred data processing operations which are performed on the vibration data, in accordance with the present invention.

FIG. 6 is a block diagram and pictorial representation of the data processing operations performed upon the microwave-transmitted data stream. As is shown, receiver 37 receives the microwave transmission, and directs it in serial form to decomutator 111 which perform a decoding function. The data is split in parallel and then directed to (1) recording device 113 for recording and selective playback, and (2) to high data rate processing system 115 which performs data processing operations on the data stream in real-time. Recording device 113 is used to store all data for later analysis and research. High data rate processing system 115 is used for real-time data analysis. Data is routed into high data rate processing system 115 at raw time data processing block 117. The data stream is simultaneously provided to frequency domain operation blocks 119, 121, 123, as well as a time-domain stabilizing signal processing operation block 125. Frequency domain operation block 119 performs spectral analysis on vibration which is in the range of 0 to 150 Hertz. Frequency domain operation block 121 performs spectral analysis of vibration which is in the frequency range of 0 to 50 Hertz. Frequency domain operation block 123 performs spectral analysis on vibration which has a frequency in the range of 0 to 1.25 Hertz.

Bit signature operation 127 operates on the output of frequency-domain operation block 119, while vibration analysis operation 127 operates on the output of frequency-domain operation blocks 121, 123. Bit signature operation 127 is an operation which identifies the spectral profile of vibration data which is characteristic of interaction of drillstring 17 and/or of rockbit 27 with the geologic formation, during normal operating conditions. This signature can be compared over time to detect changes in the signal which indicate deterioration or malfunctioning of rockbit 27. Vibration analysis operation 129 performs vibration analysis which is necessary for the Drillbyte Wellsite Information Management System of Exlog, Inc., a division of Baker Hughes Incorporated, of Houston, Tex. These operations, however, are not necessary for the detection of impending pipe sticking, which is the subject of the present invention.

The output of stabilizing signal processing operation 125, bit signature operation 127, and vibration analysis operation 129 are provided via bus 131 to a graphics and data interpretation program which is run on either a PC-based or Unix system, and which is visually represented by computing unit 133, as well as the Drillbyte Well Site Information Management System of Exlog, Inc., a division of Baker Hughes Incorporated of Houston, Tex., which is visually represented by computing unit 135. Computing unit 135 also receives data from conventional sensors 137, through slow data rate processing system 139, in a conventional manner. The data provided by conventional surface sensors includes an indication of the kelly height, the rate of penetration, and the weight on bit, but could also include the rate of rotation of drillstring 17 in revolutions per minute, torque of drillstring 17, and pump pressure in strokes per minute.

Figure 7:
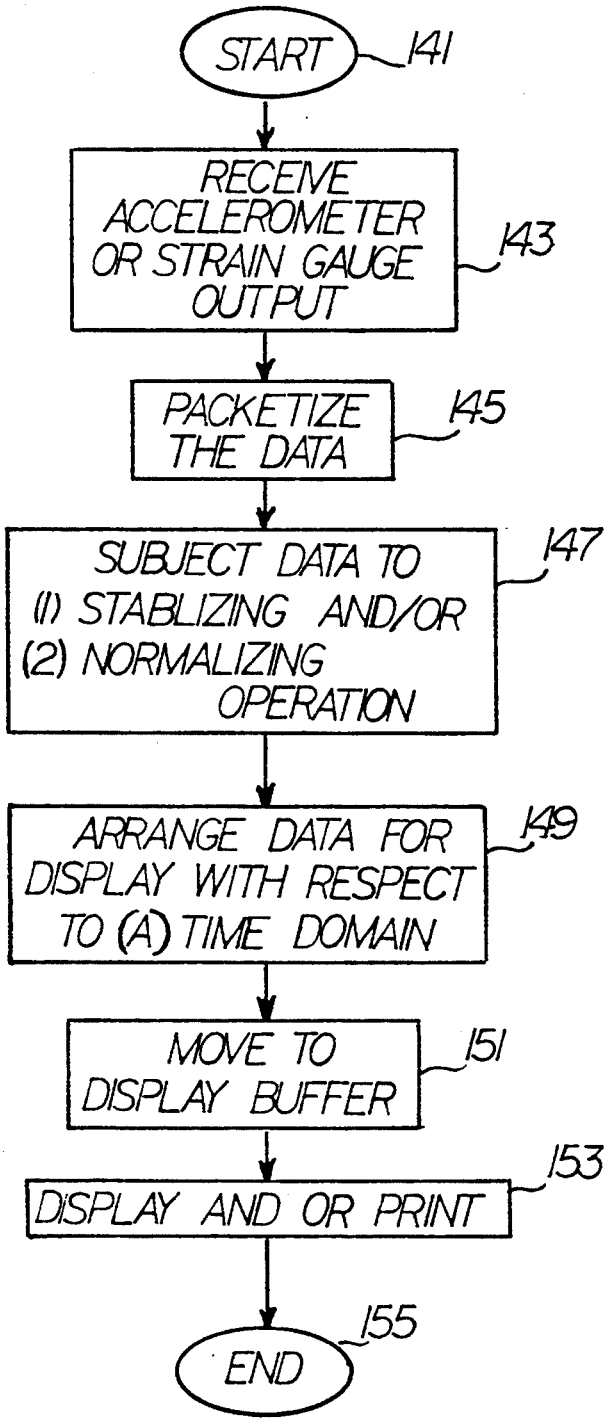
FIG. 7 is a flowchart representation of the stabilizing signal processing operation which is performed upon vibration data.

The operation of stabilizing signal processing operation 125 is depicted in flowchart form in FIG. 7. In the preferred embodiment of the present invention, the operations depicted in FIG. 7 are performed by software in a conventional data processing system; however, it may be possible to perform all these operations utilizing conventional electrical and electronic components. The objective of the stabilizing signal processing operation is to eliminate the influence of noise on the data stream, and render the data more "readable". Preferably, this includes normalizing the data to make all strain and accelerometer data positive. The process starts at software block 141, and continues in software block 143, wherein accelerometer or strain gage output data is received. Next, in accordance with software block 145, the data is packetized preferably in five second intervals. In the preferred embodiment, amplitudes for samples in each five second interval are averaged. Then, in accordance with software block 147, the data is subjected to a stabilizing and/or normalizing operation. In the preferred embodiment of the present invention, a root-mean-square (RMS) operation is performed on the data. Those skilled in the art will appreciate that the root-mean-square operation is initiated by squaring of the data, followed by averaging of the data, and concluded with taking a square root of the data. This ensures that all components of the accelerometer and/or strain gage sensors are normalized and are thus positive. Furthermore, the influence of noise components is diminished.

Next, in accordance with software block 149, the data is arranged for display with respect to a time domain, to allow comparison of the RMS amplitude of the accelerometer and/or strain gage sensor output with respect to a time axis. Preferably, the time domain provides the x-axis of any display, while the y-axis represents the RMS amplitude of the sensor output. Then, in accordance with software block 151, the data is moved to a display buffer, and in accordance with software block 153, displayed and/or printed. With reference again to FIG. 6, strip chart recorder 157 is provided in the monitoring station 39 to provide a visual print out of RMS sensor output.

The root-mean-square (RMS) operation can be presented mathematically as follows:

$$RMS \text{ Sensor Amplitude} = \sqrt{\frac{\sum_{i=1}^{N} x_i^2}{N}}$$

wherein "i" represents the series of five-second data packets, "x" represents the average sensor output for the five second interval, and "N" represents the total number of five-second data packets.

Figures 8A, 8B, 8C:
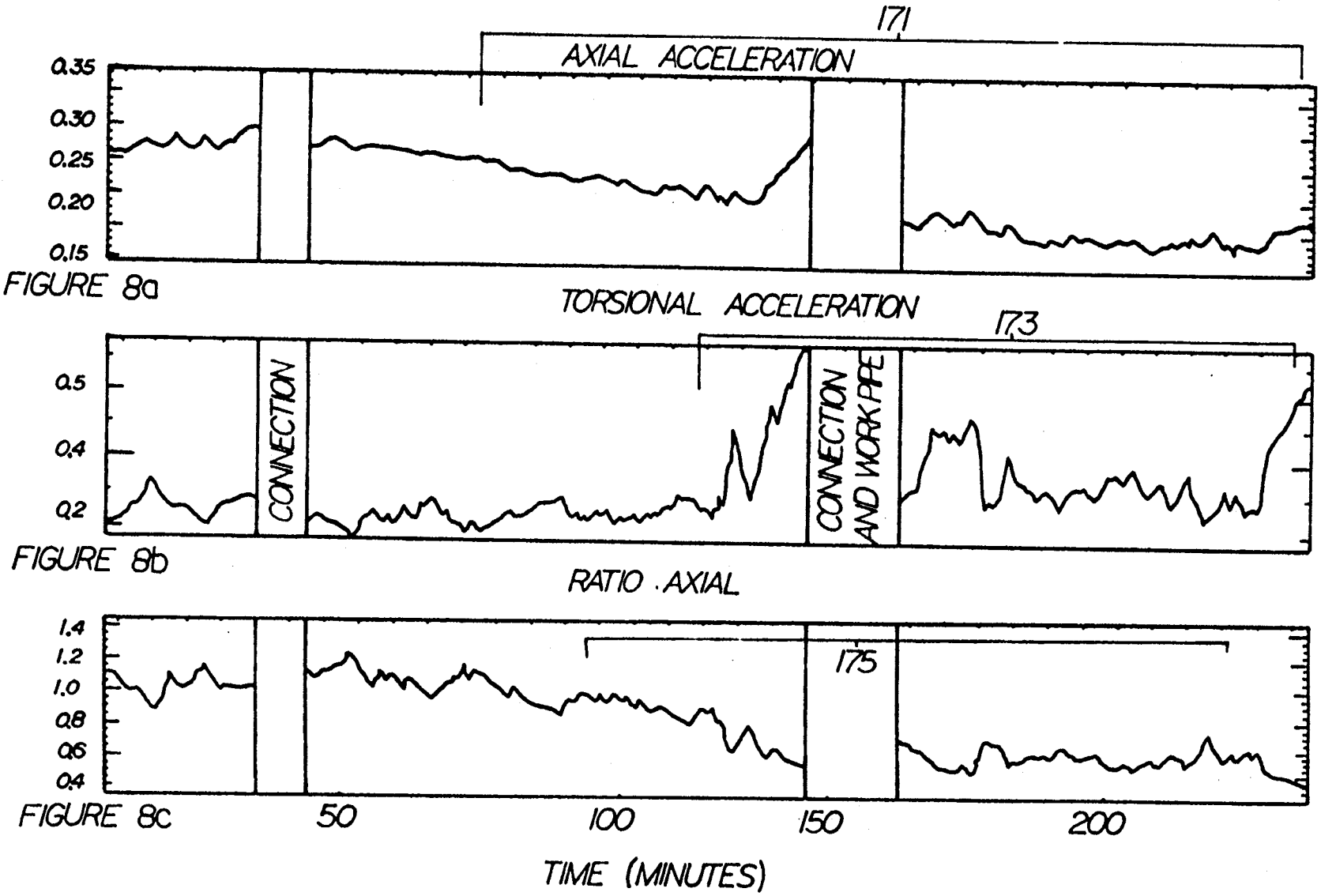
FIGS. 8*a*, 8*b*, and 8*c* graphically represent axial and torsional acceleration data in accordance with the present invention.

FIG. 8*a*, 8*b*, and 8*c* graphically depict axial acceleration with respect to time, torsional acceleration with respect to time, and a ratio of axial to torsional acceleration with respect to time, respectively, for an actual well for which vibration analysis was used to make an early detection of differential sticking using dynamic measurements from measuring subassembly 33 (of FIG. 1). Each of the figures of 8*a*, 8*b*, and 8*c* have an x-axis which represents time, and a y-axis which represents acceleration in gravity units "g". FIG. 8*a* shows RMS axial acceleration detected from measurement subassembly 33 in the frequency range of 0 to 500 Hertz for a period of four hours prior to the occurrence of a pressure differential sticking for a vertical offshore well. FIG. 8*b* represents the torsional RMS acceleration with respect to time for a period of four hours prior to the occurrence of pressure differential sticking on the same vertical offshore well, for the same time period. FIG. 8*c* depicts a ratio of RMS axial acceleration to tangential (or "torsional") acceleration with respect to time for a period of four hours prior to the occurrence of pressure differential sticking of the same vertical offshore well, for the same time periods as FIGS. 8*a* and 8*b*.

All acceleration data plotted in FIGS. 8*a*, 8*b*, and 8*c* are sensor values which have been subjected to a root-mean-square operation (RMS) to stabilize and render the data more readable. Each data point on this curve represents a five second interval, and a low pass filter has been applied to ensure that frequencies only in the range of 0 to 500 hertz are displayed.

As is depicted in the figures, axial acceleration starts to decrease in amplitude approximately two-hundred minutes before the drillstring becomes stuck, and reaches a minimum fifty minutes prior to the drillstring becoming stuck. As is also evident from the figures, the levels of torsional acceleration increased dramatically one hundred and twenty minutes prior to the drillstring becoming stuck. These features are both attributed to the increase in friction between the bottom hole assembly and the wellbore as the pipe becomes stuck. In the case of axial acceleration, the increase in friction presumably results in an increase of attenuation of detectable axial vibration originating from below the stuck point. In the case of torsional acceleration, the increase in friction results in increased dynamics as the pipe alternately "sticks" and then "frees" against the wellbore wall. FIG. 8*c* shows a ratio of the axial acceleration to the torsional acceleration, plotted with respect to time. Note that this ratio reaches a minimum immediately prior to sticking of the pipe. Also note the high levels of torsional acceleration which occur immediately prior to the connection at one hundred and fifty minutes, and prior to the pipe becoming stuck at two hundred and fifty minutes. There is an associated increase in axial acceleration at these points, although the ratio measurements decrease, as is shown in FIG. 8*c*.

With reference now to FIGS. 8*a*, 8*b*, and 8*c*, the vibration attributes which are believed to be indicative, or potentially indicative, of impending pipe stickage are:

(1) a gradual decrease in the RMS amplitude of axial vibration, as determined from either axial acceleration or axial strain measurements, for a prolonged period prior to actual sticking of the pipe in the wellbore, such as during the time period identified by span 171 in FIG. 8*a;*

(2) an increase in the RMS amplitude of torsional vibration, as detected through use of either torsional acceleration or torsional strain measurements, for a prolonged period prior to the actual occurrence of sticking of the pipe in the wellbore, such as time span 173 in FIG. 8*b;* or (3) a decrease in the ratio or the RMS values of axial to tangential vibration, as detected through either use of accelerometers or strain gauges, for a prolonged period prior to the occurrence of actual sticking of the drillstring in the wellbore, such as time span 175 in FIG. 8*c*.

In the preferred embodiment of the present invention, information pertaining to the RMS amplitude of either axial or torsional vibration is displayed on either a video display or a strip chart recorder to allow the operator to compare vibration amplitudes over a selected time interval. Preferably, the comparison is made visually, to allow a high degree of operator judgment in analyzing the data. Preferably, the vibration information is displayed along with other information pertaining to drilling conditions to allow the operator to see the interrelationship between controllable drilling conditions.

Figure 9:
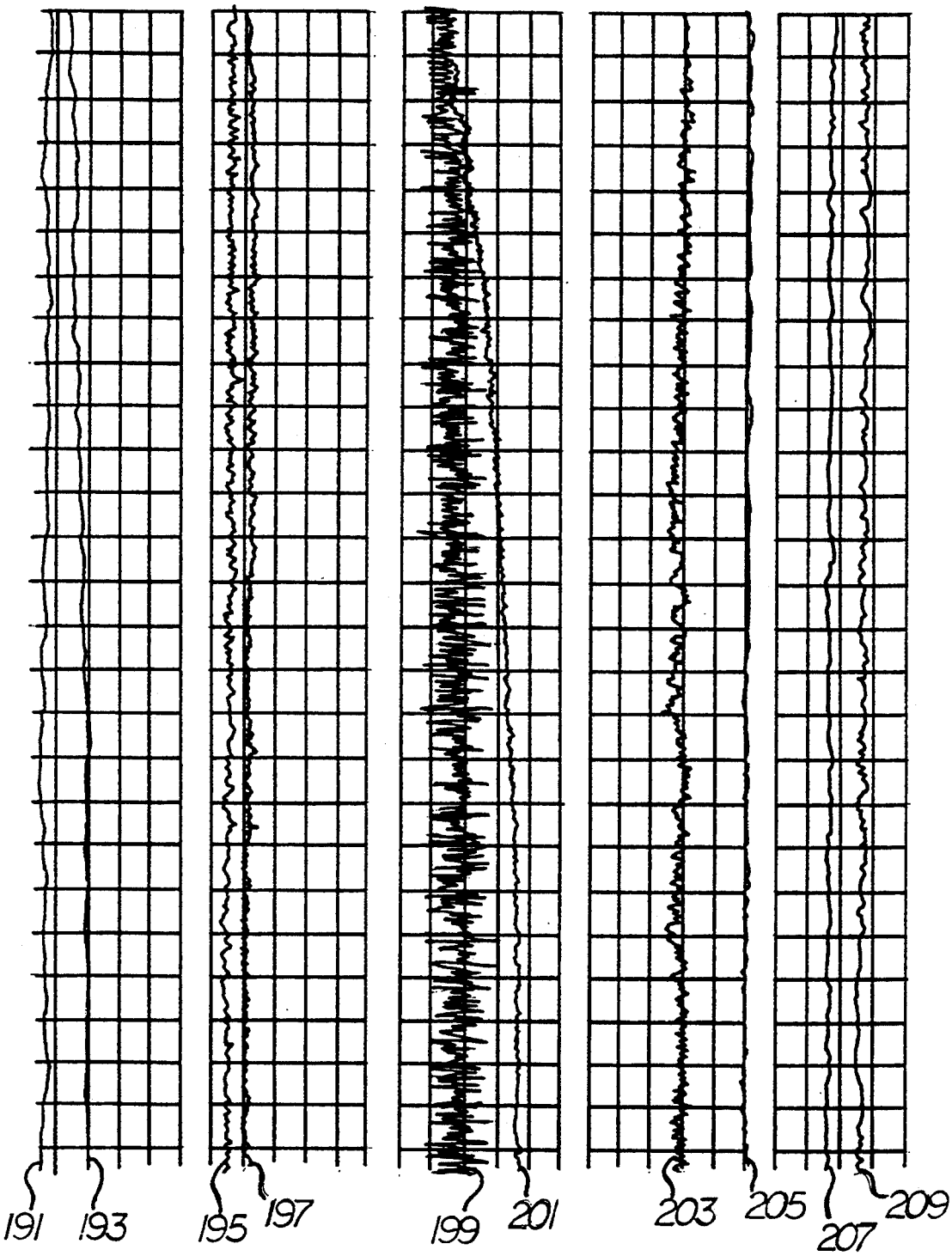
FIG. 9 is a depiction of an exemplary strip-chart recorder presentation of data which is presented to the rig operator.

FIG. 9 is an example of one strip chart presentation of a variety of drilling conditions, variables, and parameters, displayed on a common time axis (the Y-axis). Signal 191 is a signal which is representative of the rate of penetration of the drillbit 27 in the wellbore. Signal 193 is a signal which is representative of the kelly height, which provides an indication of the depth of the wellbore. Signal 195 provides a visual representation of the RMS amplitude of torsional strain data, while signal 197 provides a visual representation of the RMS amplitude of torsional acceleration. Signal 199 provides a visual representation of the RMS amplitude of axial strain, while signal 201 provides a visual representation of the RMS amplitude of axial acceleration. Signal 203 provides a visual representation of the weight-on-bit. Signal 205 is a static hook load channel, which is obtained from a static strain gauge (not depicted) in the subassembly. Signal 207 is a visual representation of the torque in the drillstring. Signal 209 is a visual representation of the speed of rotation of the drillstring in revolutions per minute. This type of display allows the operator to monitor conventional drilling conditions, such as the rate of penetration, the weight on the bit, and the rotary speed of the string, while also monitoring vibration data.

Changes in the vibration data signals will alert the operator that sticking may be about to occur, so modifications must be made in one or more drilling conditions in order to prevent the drillstring from becoming stuck. The operator may take remedial actions which include altering one or more of the drilling fluid properties, such as fluid type, fluid density, fluid viscosity, and fluid flow rates, as well as particle content. Additionally, the operator may add lubricants to the drilling fluid to minimize the possibility of differential sticking. Also, the operator may alter the frequency and amount of drillstring movement, both axial and rotary movement, to minimize the opportunity for the occurrence of differential sticking.

While the invention has been shown in only one of its forms, it is not thus limited but is susceptible to various changes and modifications.

What is claimed is:

1. A method of drilling a wellbore utilizing a drillstring, comprising:

substantially continuously sensing vibration of a drilling operation;

recording at least one signal representative of said vibration; and monitoring for a signal change in said at least one signal representative of said vibration to detect Impending sticking of said drillstring before actual sticking occurs.

2. A method according to claim 1, wherein said vibration comprises at least one of (a) axial vibration, and (b) torsional vibration.

3. A method of drilling a wellbore utilizing a drillstring, comprising:

substantially continuously sensing at least one drillstring vibration characteristic indicative of drilling interaction with said wellbore with respect to time during selected drilling operations;

recording at least one signal representative of said at least one drillstring vibration characteristic;

monitoring at least one signal characteristic with respect to time of said at least one signal; and identifying impending sticking from at least one signal change of said at least one signal.

4. A method according to claim 3, further comprising:

altering at least one drilling condition to avert sticking of said drillstring within said wellbore.

5. A method according to claim 3, wherein said step of substantially continuously sensing comprises:

substantially continuously sensing at least one vibration drillstring characteristic indicative of drillstring interaction with said wellbore with respect to time during selected drilling operations.

6. A method according to claim 3, further comprising:

subjecting said at least one signal representative of said at least one drill string characteristic to a stabilizing signal processing operation prior to said step of recording.

7. A method of determining that a drillstring in a wellbore is susceptible to sticking against a wellbore surface, comprising the steps of:

monitoring a vibration characteristic of said drillstring during drilling operations; and comparing said vibration characteristic with at least one prior vibration characteristic to identify impending sticking before actual sticking occurs.

8. A method according to claim 7, further comprising:

providing a tubular subassembly with at least one vibration sensor disposed therein;

placing said tubular subassembly in said drillstring at an upper location; and wherein said step of monitoring comprises:

monitoring a vibration characteristic of said drillstring during drilling operations with said at least one vibration sensor which is disposed in said tubular subassembly.

9. A method according to claim 7, further comprising:

subjecting a signal representative of said vibration characteristic to a stabilizing signal conditioning operation.

10. A method according to claim 9, wherein said stabilizing signal conditioning operation provides stabilized data in a time domain.

11. A method according to claim 9, wherein said stabilizing signal conditioning operation diminishes influence of noise upon vibration data.

12. A method according to claim 7, further comprising:

displaying at least one signal indicative of said vibration characteristic with respect to time to allow comparison with at least one prior vibration characteristic.

13. A method according to claim 7, further comprising:

altering at least one drilling condition in response to detection of impending sticking to avoid sticking of said drillstring against said wellbore surface.

14. A method according to claim 7, further comprising:

providing at least one vibration characteristic sensor;

placing said at least one vibration characteristic sensor in a selected position within said drillstring;

during drilling operations, generating at least one output signal from said at least one vibration characteristic sensor; and subjecting said at least one output signal to a stabilizing signal conditioning operation.

15. A method according to claim 14, further comprising:

altering at least one drilling condition in response to detection of impending sticking to avoid sticking of said drillstring against said wellbore surface.

16. A method of determining that a drillstring in a wellbore is susceptible to sticking against a wellbore surface, comprising the steps of:

monitoring vibration of said drillstring during drilling operations; and comparing vibration amplitudes with at least one prior vibration amplitude to identify amplitude changes which are characteristic of impending sticking in order to detect impending sticking before actual sticking occurs.

17. A method according to claim 16, wherein said step of monitoring comprises:

monitoring at least one of (1) axial vibration, and (2) torsional vibration, during drilling operations.

18. A method according to claim 16, wherein said step of monitoring comprises:

monitoring axial vibration of said drillstring during drilling operations.

19. A method according to claim 16, wherein said step of monitoring comprises:

monitoring vibration through measurement of axial acceleration of said drillstring during drilling operations.

20. A method according to claim 19, wherein said step of comparing comprises:

comparing vibration amplitudes with prior vibration amplitudes, through measurements of axial acceleration, to identify amplitude changes which are characteristic of impending sticking.

21. A method according to claim 19, wherein said step of comparing comprises:

comparing vibration amplitudes with prior vibration amplitudes, through measurement of axial acceleration, to identify amplitude diminishment which is characteristic of impending sticking.

22. A method according to claim 16, wherein said step of monitoring comprises:

monitoring vibration through measurement of axial strain of said drillstring during drilling operations.

23. A method according to claim 22, wherein said step of comparing comprises:

comparing vibration amplitudes with prior vibration amplitudes, through measurement of axial strain, to identify amplitude changes which are characteristic of impending sticking.

24. A method according to claim 22, wherein said step of comparing comprises:

comparing vibration amplitudes with prior vibration amplitudes, through measurement of axial strain, to identify amplitude diminishment which is characteristic of impending sticking.

25. A method according to claim 16, wherein said step of comparing comprises:

comparing vibration amplitudes with prior vibration amplitudes to identify amplitude diminishment which is characteristic of impending sticking.

26. A method according to claim 16, further comprising:

providing a tubular subassembly with at least one vibration sensor disposed therein;

placing said tubular subassembly in said drillstring at an upper location; and wherein said step of monitoring comprises:

monitoring vibration amplitudes of said drillstring during drilling operations with said at least one vibration sensor which is disposed in said tubular subassembly.

27. A method according to claim 26, wherein said at least one vibration sensor comprises at least one accelerometer.

28. A method according to claim 27, wherein said at least one accelerometer comprises:

at least one accelerometer positioned for measurement of axial vibration; and at least one accelerometer positioned for measurement of torsional vibration.

29. A method according to claim 26, wherein said at least one vibration sensor comprises at least one strain gauge sensor.

30. A method according to claim 29, wherein said at least one strain gauge sensor comprises:

at least one strain gauge sensor positioned for measurement of axial vibration; and at least one strain gauge sensor positioned for measurement of torsional vibration.

31. A method according to claim 16, further comprising subjecting at least one output signal which is indicative of vibration to a stabilizing signal conditioning operation.

32. A method according to claim 31, wherein said stabilizing signal conditioning operation normalizes said at least one output signal.

33. A method according to claim 31, wherein said stabilizing signal conditioning generation provides stabilized data in a time domain.

34. A method according to claim 31, wherein said stabilizing signal conditioning operation diminishes influence of noise upon said at least one output signal which is indicative of vibration.

35. A method according to claim 16, further comprising:

displaying at least one signal indicative of vibration with respect to time to allow comparison of vibration amplitudes.

36. A method according to claim 16, further comprising:

altering at least one drilling condition in response to detection of impending sticking to avoid sticking of said drillstring against said wellbore.

37. A method according to claim 16, further comprising:

providing at least one vibration sensor;

placing said at least one vibration sensor in a selected position within said drillstring;

during drilling operations, generating at least one output signal from said at least one vibration sensor which is indicative of vibration in said drillstring; and subjecting said at least one output signal to a stabilizing signal conditioning operation.

38. A method of drilling an oil and gas wellbore with a drillstring disposed in said wellbore and submerged in a drilling fluid, comprising the method steps of:

rotating said drillstring in said wellbore;

monitoring a vibration characteristic of said drillstring during drilling operations;

comparing said vibration characteristic with at least one prior vibration characteristic to identify impending sticking of said drillstring against a wellbore surface before sticking of said drillstring actually occurs; and upon identification of impending sticking, altering at least one drilling condition to avoid sticking of said drillstring against said wellbore surface.

39. A method according to claim 38, wherein said step of monitoring comprises:

monitoring at least one signal indicative of at least one of (1) axial vibration and (2) torsional vibration, during drilling operations.

40. A method according to claim 38, wherein said at least one drilling condition includes at least one of:

(1) composition of said drilling fluid;

(2) axial position of said drillstring; and (3) speed of rotation of said drillstring.

41. An apparatus for determining that a drillstring is susceptible to sticking against a wellbore surface, comprising:

means for substantially continuously sensing a real-time vibration property of said drillstring;

means for recording at least one signal representative of said real-time vibration property; and means for monitoring for a signal change in said at least one signal representative of said real-time property to detect impending sticking before actual sticking occurs.

42. An apparatus according to claim 41, wherein said vibration comprises at least one of (a) axial vibration, and (b) torsional vibration.

43. An apparatus for determining that a drillstring is susceptible to sticking against a wellbore surface, comprising:

means for substantially continuously sensing at least one drillstring characteristic with respect to time during selected drilling operations;

means for recording at least one signal representative of said at least one drillstring vibration characteristic; and means for allowing monitoring of at least one signal characteristic of said at least one signal to allow identification of impending sticking before actual sticking occurs from at least one signal change.

44. An apparatus for determining that a drillstring in a wellbore is susceptible to sticking against a wellbore surface, comprising:

means for monitoring a vibration characteristic of said drillstring during drilling operations; and means for comparing said vibration characteristic with at least one prior vibration characteristic to identify impending sticking.

45. An apparatus according to claim 44, further comprising:

a tubular subassembly with at least one vibration sensor disposed therein; and means for securing said tubular subassembly in said drillstring at a selected location.

46. An apparatus according to claim 44, further comprising:

signal processing means for subjecting a signal representative of said vibration characteristic to a stabilizing signal conditioning operation.

47. An apparatus according to claim 46, wherein said signal processing means provides stabilized data in a time domains.

48. An apparatus for determining that a drillstring in a wellbore is susceptible to sticking against a wellbore surface, comprising:

means for monitoring vibration of said drillstring during drilling operations; and means for comparing vibration amplitudes with at least one prior vibration amplitude to identify amplitude changes which are characteristic of impending sticking.

49. An apparatus according to claim 48, wherein said means for monitoring comprises:

means for monitoring at least one of (1) axial vibration, and (2) torsional vibration, during drilling operations.

50. An apparatus according to claim 48, wherein said means for monitoring comprises:

means for monitoring axial vibration of said drillstring during drilling operations.

51. An apparatus according to claim 48, wherein said means for monitoring comprises:

means for monitoring vibration through measurement of axial acceleration of said drillstring during drilling operations.

52. An apparatus according to claim 51, wherein said means for comparing comprises:

means for comparing vibration amplitudes with prior vibration amplitudes, through measurement of axial acceleration, to identify amplitude diminishment which is characteristic of impending sticking.

53. An apparatus according to claim 48, wherein said means for comparing comprises:

means for comparing vibration amplitudes with prior vibration amplitudes, through measurements of axial acceleration, to identify amplitude changes which are characteristic of impending sticking.

54. An apparatus according to claim 53, wherein said means for comparing comprises:

means for comparing vibration amplitudes with prior vibration amplitudes, through measurement of axial strain, to identify amplitude diminishment which is characteristic of impending sticking.

55. An apparatus according to claim 48, wherein said means for monitoring comprises:

means for monitoring vibration through measurement of axial strain of said-drillstring during drilling operations.

56. An apparatus according to claim 48, wherein said means for comparing comprises:

means for comparing vibration amplitudes with prior vibration amplitudes, through measurement of axial strain, to identify amplitude changes which are characteristic of impending sticking.

57. An apparatus according to claim 48, wherein said means for comparing comprises:

means for comparing vibration amplitudes with prior vibration amplitudes to identify amplitude diminishment which is characteristic of impending sticking.

58. A method of drilling a wellbore utilizing a drillstring, comprising:

substantially continuously sensing a real-time vibration property of a drillstring during drilling operation at a surface location;

recording at least one signal representative of said real-time vibration property; and monitoring for a signal change in said at least one signal representative of said real-time property to detect impending sticking of said drillstring before actual sticking occurs.

59. A method according to claim 58, wherein said vibration comprises at least one of (a) axial vibration, and (b) torsional vibration.

60. A method of determining that a drillstring in a wellbore is susceptible to sticking against a wellbore surface, comprising the steps of:

monitoring a vibration characteristic of said drillstring during drilling operations from only a surface location; and comparing said vibration characteristic with at least one prior vibration characteristic to identify impending sticking before actual sticking occurs.

61. A method according to claim 60, further comprising:

providing a tubular subassembly with at least one vibration sensor disposed therein;

placing said tubular subassembly in said drillstring at a surface location; and wherein said step of monitoring comprises:

monitoring a vibration characteristic of said drillstring during drilling operations with said at least one vibration sensor which is disposed in said tubular subassembly.

62. A method of drilling an oil and gas wellbore with a drillstring disposed in said wellbore and submerged in a drilling fluid, comprising the method steps of:

rotating said drillstring in said wellbore;

conducting vibrations through said drillstring to a surface location;

monitoring a vibration characteristic of said drillstring during drilling operations from said surface location;

comparing said vibration characteristic with at least one prior vibration characteristic to identify impending sticking of said drillstring against a wellbore surface before sticking of said drillstring actually occurs; and upon identification of impending sticking, altering at least one drilling condition to avoid sticking of said drillstring against said wellbore surface.

63. A method according to claim 62, wherein said step of monitoring comprises:

monitoring at least one signal indicative of at least one of (1) axial vibration and (2) torsional vibration, during drilling operations.

64. A method according to claim 63, wherein said at least one drilling condition includes at least one of:

(1) composition of said drilling fluid;

(2) axial position of said drillstring; and (3) speed of rotation of said drillstring.

* * * * *